United States Patent [19]

Willcocks

[11] Patent Number: 4,796,789

[45] Date of Patent: Jan. 10, 1989

[54] DUAL-FUNCTION GOLF BAG

[76] Inventor: Reginald Willcocks, 1 Joel Pl., Port Washington, N.Y. 11050

[21] Appl. No.: 761,788

[22] Filed: Aug. 2, 1985

[51] Int. Cl.[4] ..... A63B 55/00

[52] U.S. Cl. ..... 224/202; 224/274; 150/52 G; 190/111; 206/315.2

[58] Field of Search ..... 224/274, 202; 150/526; 190/111, 112; 206/315.2, 315.3; 27/14, 16, 17

[56] References Cited

U.S. PATENT DOCUMENTS

| | | | |
|---|---|---|---|
| 1,637,538 | 8/1927 | Sampson | 206/315.2 |
| 2,064,542 | 12/1936 | Jones | 224/202 |
| 2,213,821 | 9/1940 | McCurdy | 190/111 |
| 2,428,954 | 10/1947 | Apblett et al. | 224/274 X |
| 2,501,270 | 3/1950 | Fleming | 224/922 X |
| 3,549,064 | 12/1970 | Wilson | 224/202 X |
| 3,678,611 | 7/1972 | Files | 224/202 X |
| 3,746,204 | 7/1973 | Nagai . | |
| 4,182,391 | 1/1980 | Kjose | 224/202 |
| 4,375,847 | 3/1983 | Picco | 224/202 |
| 4,383,563 | 5/1983 | Kirchoff, Jr. | 206/315.2 |
| 4,522,299 | 6/1985 | Clark et al. . | |

FOREIGN PATENT DOCUMENTS

| | | | |
|---|---|---|---|
| 585845 | 2/1947 | United Kingdom | 190/111 |

*Primary Examiner*—Henry J. Recla

*Attorney, Agent, or Firm*—Michael Ebert

[57] ABSTRACT

A golf bag adapted to function as a shoulder carrier for a set of golf clubs or as a locked travel case therefor suitable for air transport. The bag, which is molded of rigid plastic material, has a generally cylindrical form closed at either end, the bag being composed of a semi-cylindrical chest section and a semi-cylindrical lid section hinged thereto. The lid section is divided into a major lid which extends from the bottom end of the bag to an upper level below the top end, and a minor lid which extends from the upper level to the top end whereby when the minor lid is swung open, the heads of the golf clubs whose long handles rest on the bottom of the bag are then accessible for removal. The major and minor lids are provided with raised edge borders which, when the lids are closed, overlie corresponding edges of the chest section. The longitudinal course on the borders of the lids have releasable clamps mounted thereon adapted to engage complementary anchor hooks on the chest section. Only the clamp on the minor lid is lockable so that it cannot then be released. The circumferential course on the edge border at the lower end of the minor lid overlies the adjacent border course on the major lid, so that when the minor lid is locked, this effectively acts to lock the major lid which cannot be swung open without first unlocking the minor lid.

6 Claims, 3 Drawing Sheets

DUAL-FUNCTION GOLF BAG

BACKGROUND OF INVENTION

1. Field of Invention

This invention relates generally to golf bags for storing golf clubs and other items required in playing golf; and more particularly to a dual-function golf bag adapted to function both as a relatively light-weight shoulder carrier for golf clubs to be carried by a player or caddy on a golf course, or as a locked travel case which can be safely transported in the luggage hold of a commercial aircraft or otherwise shipped without damage to its contends.

2. Status of Prior Art

A complete set of golf clubs for playing the game of golf consists of four woods (driver, brassie, spoon and click), ten irons (driving iron, mid iron, mashie, etc.) and a putter. The woods, which are standardized with the numbers 1 to 4, are used by the golfer for long drives; the irons, which are standarized with the numbers 1 to 10, are used for shorter shots, whereas the putter is employed only on the green. All of the clubs have a long handle to which is attached a shaped head of some sort, depending on the function of the club.

The traditional golf bag is fabricated of leather or fabric material and is adapted to hold a full complement of golf clubs. It is also provided with side pockets for storing a supply of golf balls and other items such as golf shoes. Because a loaded golf bag is fairly heavy, it includes a shoulder strap to make it easier to carry on the golf course. And the bag is also provided with a handle so that it can be carried as a piece of luggage.

Golf is played competitively by both professionals and amateurs, and since golf courses are scattered throughout the country, many players often have occasion to travel by air to a vacation resort or other remote playing site. The traditional golf bag is relatively soft and flexible; and while it affords adequate protection to its contents when the bag is placed in the trunk of an automobile or on a golf cart, it is not acceptable as a piece of luggage to be stored in the luggage-hold of a commercial aircraft where pieces of luggage are stacked one above the other and are therefore subjected to heavy pressures.

It is for this reason that many commercial airlines refuse to accept golf bags as luggage. A player cannot carry his golf bag to his seat within the plane, for it is too bulky to be stored under the seat or in an overhead rack. If, therefore, air transport is required, the golf bag must be placed within a travel container acceptable to commercial airlines. The need exists, therefore, for a golf bag which is not only capable of holding all necessary playing equipment, but which is also adapted to function as a locked travel case suitable for all modes of transportation.

SUMMARY OF INVENTION

In view of the foregoing, the main object of this invention is to provide a dual-function golf bag adapted to function either as a shoulder carrier for a set of golf clubs or as a locked travel case therefor suitable for air and other forms of public transportation.

A significant feature of the invention is that the dual-function bag, though of sufficient strength and rigidity to form a travel case which protects the golf clubs and other golf accessories from the rigors of travel, is no bulkier or appreciably heavier than a traditional golf bag. Thus, the same bag is operable in either the playing mode on the golf course or in a locked travel model.

More particularly, an object of this invention is to provide a golf bag of the above type which includes a chest section and a lid section hinged thereto, the lid section having a minor lid that when swung open exposes only the heads of the golf clubs housed in the bag, whereby the clubs may then be removed from the bag, the lid section also having a major lid which when swung open provides full access to the chest section.

Also an object of the invention is to provide a golf bag of the above type which is adapted to store golf balls as well as other golf accessories within the bag itself and not in outside pockets as in conventional bags, so that in the locked travel mode, one is denied access to these accessories.

Briefly stated, these objects are attained in a golf bag adapted to function as a shoulder carrier for a set of golf clubs or as a locked travel case therefor suitable for air transport. The bag, which is molded of rigid plastic material, has a generally cylindrical form closed at either end, the bag being composed of a semi-cylindrical chest section and a semi-cylindrical lid section hinged thereto. The lid section is divided into a major lid which extends from the bottom end of the bag to an upper level below the top end, and a minor lid which extends from the upper level to the top end whereby when the minor lid is swung open, the heads of the golf clubs whose long handles rest on the bottom of the bag are then accessible for removal. The major and minor lids are provided with raised edge borders which, when the lids are closed, overlie corresponding edges of the chest section. The longitudinal course on the borders of the lids have releasable clamps mounted thereon adpated to engage complementary anchor hooks on the chest section. Only the clamp on the minor lid is lockable so that it cannot then be released. The circumferential course on the edge border at the lower end of the minor lid overlies the adjacent border course on the major lid, so that when the minor lid is locked, this effectively acts to lock the major lid which cannot be swung open without first unlocking the minor lid.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
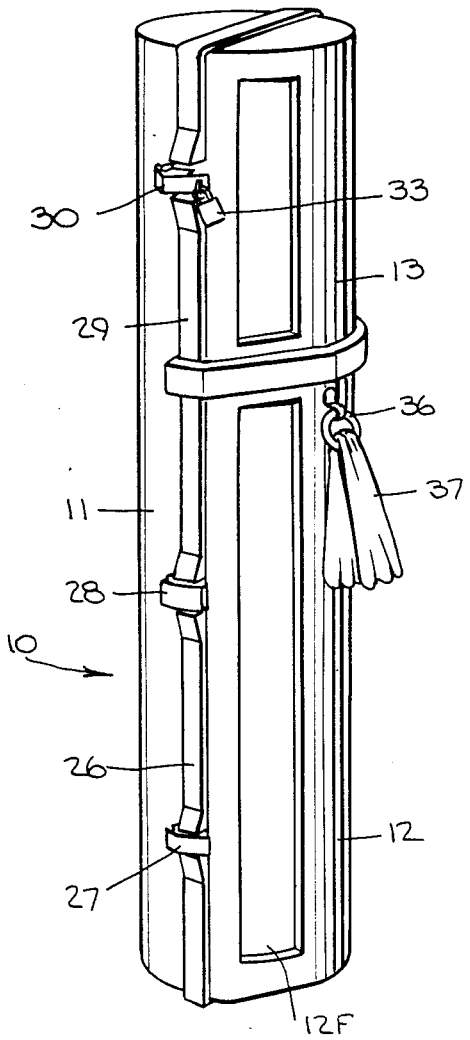
FIG. 1 is a perspective view of a dual-function golf bag in accordance with the invention as seen in the locked travel mode, as viewed from the front.
Figure 2:
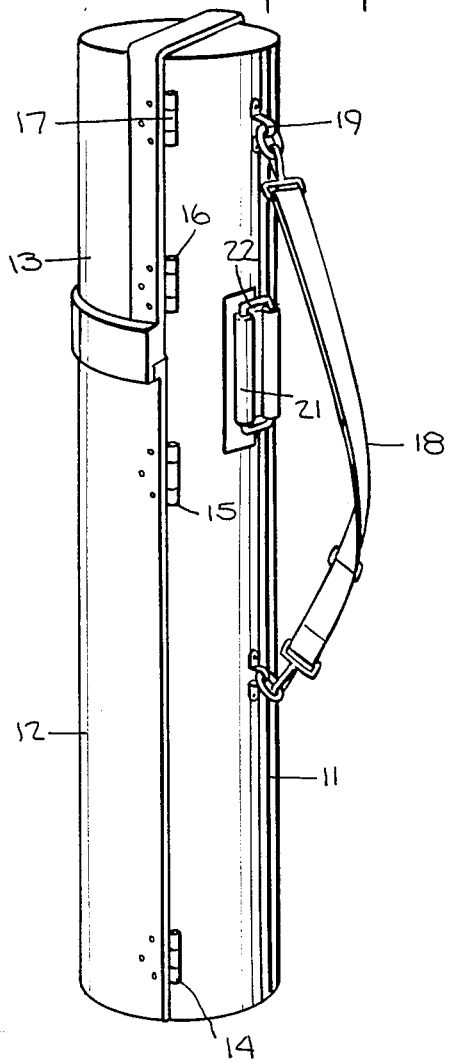
FIG. 2 shows the bag in the locked travel mode, as viewed from the rear.
Figure 3:
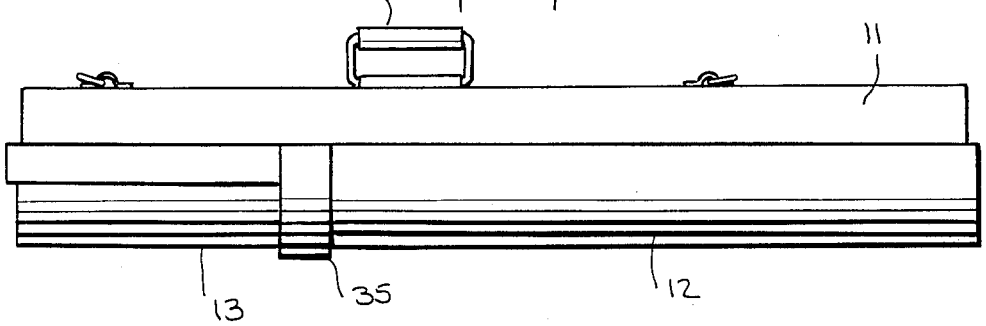
FIG. 3 is a side view of the bag in the locked travel mode.

Referring now to FIGS. 1 to 3, there is shown a dual-function golf bag 10 in accordance with the invention, the bag being in a generally cylindrical form closed at either end. The bag, which is rigid, is molded of a reinforced synthetic plastic material such as polystyrene, polypropylene, acetal or polycarbonate material, preferably reinforced with glass fibers to enhance the impact resistance, shear and tensile strength and other structural properties of the plastic.

The bag is composed of a semi-cylindrical chest section 11 to which is hinged a semi-cylindrical lid section that is divided into a major lid 12 and a minor lid 13. Major lid 12, which extends from the bottom end of the bag to an upper level below the top end, is hinged to the chest section 11 by a pair of hinges 14 and 15. Minor lid 13, which extends from the upper level to the top end of the bag, is hinged to the chest section by a pair of hinges 16 and 17. Thus, the chest section is enclosed only when both hinged lids are shut.

Figure 6:
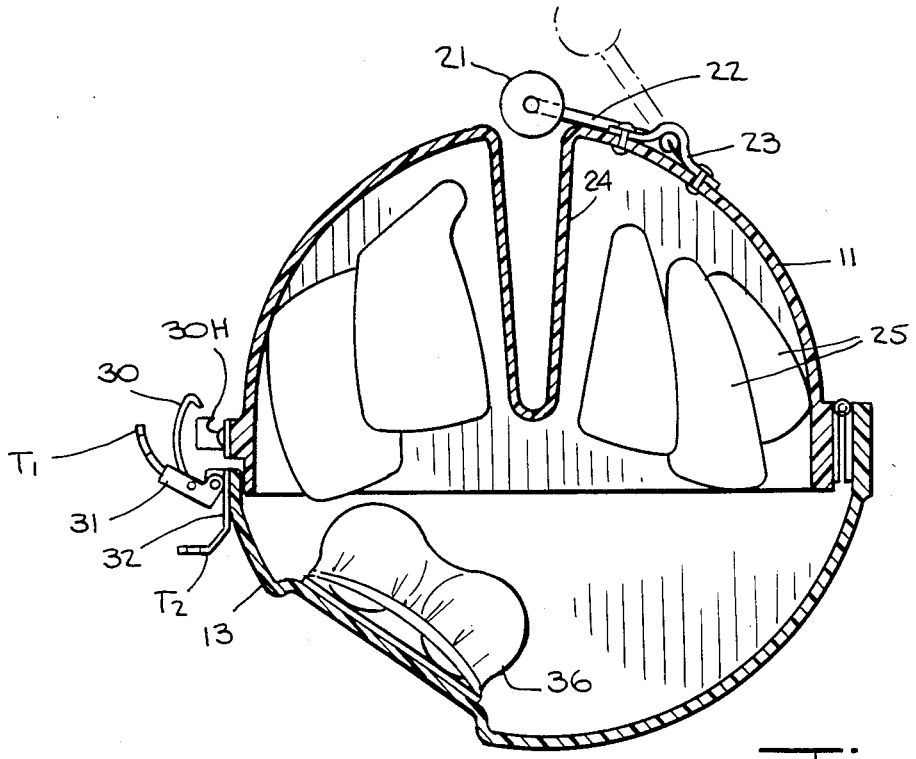
FIG. 6 is a transverse section taken through the minor lid at a position above the heads of the golf clubs when the minor lid is closed.
Figure 7:
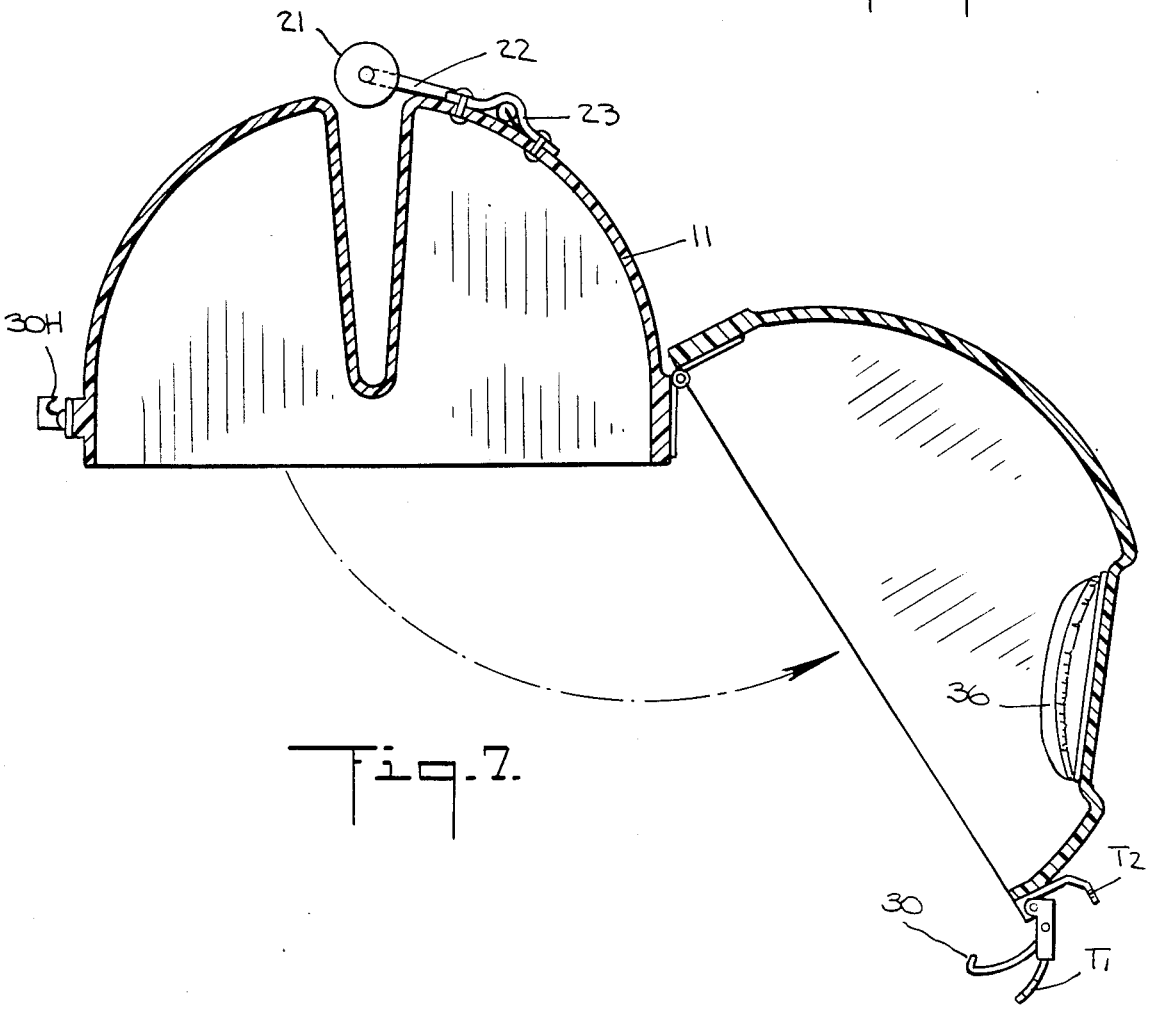
FIG. 7 is a transverse section as in FIG. 6, but with the minor lid swung open.

An adjustable shoulder strap 18 is coupled to the bag, the upper end of the strap being linked to a fixture 19 attached to chest section 11 adjacent the upper end of the bag, the lower end of the strap being linked to a fixture 20 attached to the chest section at a position below its midpoint. Also provided on chest section 11 under strap 18 is a handle 21 which is supported between the spaced arms of a handle connector 22 pivoted on a fixture 23 secured to chest section 11. Thus handle 21 may be raised above the chest section in order to carry the bag as a piece of luggage, as shown in FIG. 6. Or handle 21 may be retracted so that it lies above the recess of a hollow, double-wall divider 24 which acts as a midpoint partition within the chest section.

Figure 5:
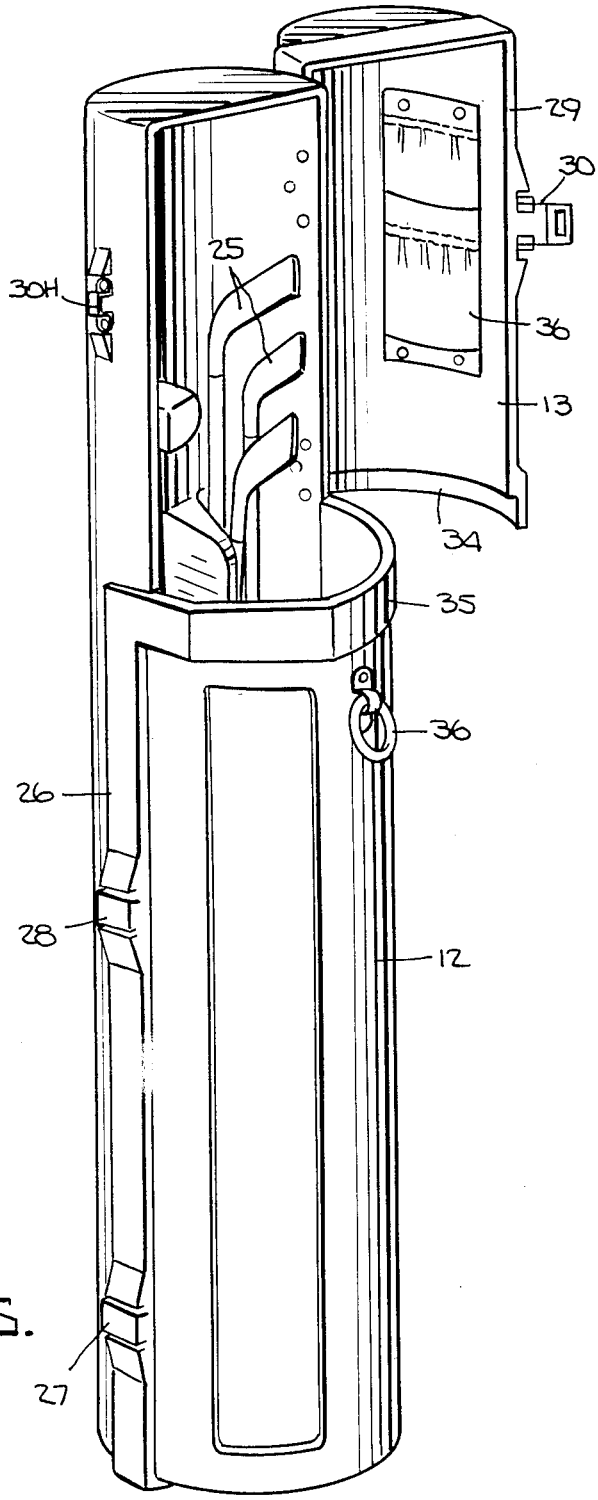
FIG. 5 shows the bag with golf clubs stored in its chest section, the major lid hinged to the chest section being closed and the minor lid being swung open to expose the heads of the clubs, so that the bag is now in the playing mode.

As shown in FIGS. 5 and 6, one may store in chest section 11 a full set of golf clubs 25, with the irons placed on one side of divider 24 and the woods and the putter placed on the other side. The long handles of the club rest on the bottom of the bag.

The edges of major lid 12 are provided with a raised border which includes a longitudinal course 26 that overlies the corresponding edge of chest section 11. Mounted at spaced positions on border course 26 is a pair of releasable clamps 27 and 28. These clamps, when major lid 12 is closed, are adapted to engage complementary anchor hooks 27H and 28H attached to chest section 11.

The edges of minor lid 13 are provided with a raised border which includes a longitudinal course 29 that overlies the corresponding edge of chest section 11. Mounted on border course 29 is a single releasable clamp 30 which, when minor lid 13 is closed, is adapted to engage a complementary hook 30H attached to chest section 11.

As best seen in FIG. 6, clamp 30 is supported on a lever 31 pivotally mounted on a bracket 32 secured to minor lid 13. By swinging lever 30 out from the bracket, clamp 30 may be brought into engagement with its complementary anchor hook 30H, and by then retracting lever 31 against bracket 32, the clamping engagement is then maintained. Lever 31 is provided with an extension tab $T_1$ having a hole therein, tab $T_1$ lying against a like tab $T_2$ extending from bracket 32 when the lever is retracted, at which position the holes in tabs $T_1$ and $T_2$ are in registration.

To lock clamp 30, the shackle of a padlock 33, as shown in FIG. 1, is passed through the holes in the tabs, Only the clamp 30 for the minor lid is provided with such locking tabs, the clamps 27 and 28 on the major lid 11 being without locking means. But the arrangement is such that by locking clamp 30 for the minor lid, this effectively locks the major lid.

This locking action is effected by the circumferential course 34 at the lower end of the edge border on minor lid 13. As shown in FIG. 5, course 34 projects downwardly from the lower end of the minor lid and is provided with an arcuate indentation, so that when major lid 12 is closed over the chest section 11 and minor lid 13 is then swung to its closed position, the circumferential border course 34 of the minor lid then overlies the circumferential border course 35 at the upper end of major lid 12.

As a consequence, when major lid 32 is shut and clamped, and minor lid 13 is then shut, clamped and locked by means of padlock 33, one cannot then swing major lid 32 open without first unlocking, unclamping and swinging open minor lid 13. Thus, a single padlock effectively locks both the minor and major lids. This makes it easier to operate the golf bag in the travel mode, for a single padlock provides the necessary security against unauthorized access to the bag contents.

Figure 4:
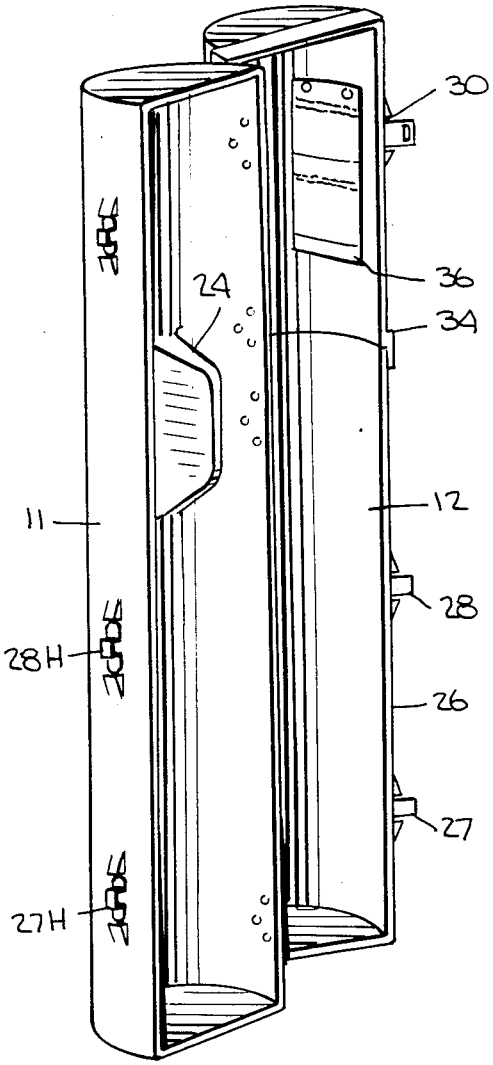
FIG. 4 is a perspective view of the bag in its fully open state and with no golf clubs therein.

Riveted or otherwise attached to the interior of minor lid 13, as best seen in FIGS. 4 and 5, is a golf ball holder 36. This is provided with expandable upper and lower pockets for accommodating golf balls 37 (see FIG. 6). When major lid 12 is then closed over chest section 11, the resultant tubular compartment formed therein is sufficiently commodious to accommodate not only a full set of golf clubs, but also golf shoes, a golf shirt and other golfing accessories.

Normally, on a golf course the player requires a towel; and for this purpose, on the exterior of minor lid 13 is pivotally attached a loop 36, as shown in FIG. 5. This loop receives a towel 37, as shown in FIG. 8.

Major lid 12 is molded to include a longitudinally extending flat strip section 12F, which may be used to support a decorative strip or printed matter, and the minor lid 13 is provided with a similar flat strip 13F. This flat region also serves to prevent the generally cylindrical bag from rolling.

Thus when the bag is used in the playing mode, it is borne by the player or caddy by means of shoulder strap 18; and to obtain access to the golf clubs and golf accessories one merely unclamps and swings open the minor lid. When, however, the bag is to be used in the travel mode as a piece of luggage, both lids are clamped to the chest section and the minor lid is locked, the bag then being carried by its handle 21.

While there has been shown and described a preferred embodiment of DUAL-FUNCTION GOLF BAG in accordance with the invention, it will be appreciated that many changes and modifications may be made therein without, however, departing from the essential spirit thereof. Thus instead of releasable clamps engaging anchor hooks, other known forms of latching elements and cooperating anchors may be used for the same purpose, as long as the latching element on the minor lid can be locked to its anchor.

I claim:

1. A golf bag adapted to function as a shoulder carrier for a set of golf clubs and other golf game accessories or as a locked travel case therefor suitable for air transport, said bag having a closed, generally-cylindrical form to store said clubs and comprising:

(A) a semi-cylindrical chest section;

(B) a semi-cylindrical lid section hinged to said chest section, said lid section being divided into a major lid which extends from the closed bottom end of the bag to an upper level below the closed top end, and a minor lid which extends from the upper level of the closed top end, whereby when the minor lid is swung open, the heads of the golf clubs stored in said bag are accessible for removal, the long handles of the clubs resting on the closed bottom end of the bag;

(C) raised edge borders on the major and minor lids which, when the lids are closed, overlie the corresponding edge of the chest section, said edge borders each including a longitudinal course which is parallel to the longitudinal edge of the chest section, the border on the minor lid having at its lower end a circumferential course that overlies a circumferential border course in the upper end of the major lid, whereby the major lid cannot be swung open without first swinging open the minor lid;

(D) releasable latching means on the longitudinal border courses of the major and minor lids adapted to engage complementary anchors on the chest section;

(E) a lock to lock the latching means for the minor lid to its anchor, whereby neither the major nor the minor lid can be swung open without first unlocking the lock and a single lock provides the necessary security against unauthorized access to the contents of the bag, said chest section and said lid section being molded of synthetic plastic material; and (F) a shoulder strap linked to the exterior of said chest section and a handle attached to said chest section under the strap.

2. A golf bag as set forth in claim 1, wherein said plastic is reinforced by glass fibers.

3. A golf bag as set forth in claim 1, wherein said latching means is constituted by a clamp supported on a lever pivoted to a bracket attached to the minor lid, the lever being swingable to cause the clamp to engage a hook anchor attached to the chest section, whereby when the lever is retracted against the bracket, the engagement is then maintained.

4. A golf bag as set forth in claim 3, wherein said lever is provided with an extension tab having a hole therein, and said bracket is provided with a tab which registers with the lever tab when the lever is retracted, whereby the shackle of a padlock may be inserted through the holes of the registered tabs.

5. A golf bag as set forth in claim 1, wherein said chest section is provided with an inner partition to separate some of the golf clubs in the set from the others.

6. A golf bag as set forth in claim 1, wherein said minor lid has a golf ball holder attached to the interior surface thereof.

* * * * *